US009360180B2

(12) United States Patent
Sorensen et al.

(10) Patent No.: US 9,360,180 B2
(45) Date of Patent: Jun. 7, 2016

(54) CEILING-RECESSED LUMINAIRE

(71) Applicant: ABL IP Holding LLC, Conyers, GA (US)

(72) Inventors: Chris Sorensen, Denver, CO (US); Peter K. Nelson, Denver, CO (US); Carl Gould, Golden, CO (US)

(73) Assignee: ABL IP Holding LLC, Decatur, GA (US)

( * ) Notice: Subject to any disclaimer, the term of this patent is extended or adjusted under 35 U.S.C. 154(b) by 267 days.

(21) Appl. No.: 13/888,195

(22) Filed: May 6, 2013

(65) Prior Publication Data

US 2013/0294061 A1 Nov. 7, 2013

Related U.S. Application Data

(60) Provisional application No. 61/642,795, filed on May 4, 2012.

(51) Int. Cl.

| | |
|---|---|
| ***F21S 8/00*** | (2006.01) |
| ***F21S 8/06*** | (2006.01) |
| ***H01R 13/627*** | (2006.01) |
| ***F21V 21/04*** | (2006.01) |
| ***F21S 8/04*** | (2006.01) |
| ***H01R 31/06*** | (2006.01) |
| ***F21S 8/02*** | (2006.01) |
| *H01R 25/14* | (2006.01) |

(52) U.S. Cl.

CPC .. *F21S 8/06* (2013.01); *F21S 8/026* (2013.01); *F21S 8/046* (2013.01); *F21V 21/04* (2013.01); *H01R 13/627* (2013.01); *H01R 31/06* (2013.01); *H01R 25/145* (2013.01)

(58) Field of Classification Search

CPC ..... F21V 21/04–21/046; F21V 8/06; F21V 21/047–21/049

USPC ..... 362/219, 225, 217.1–217.17, 364–365, 362/147–150

See application file for complete search history.

(56) References Cited

U.S. PATENT DOCUMENTS

| | | | | |
|---|---|---|---|---|
| 7,513,640 | B2 * | 4/2009 | Hendrikus | 362/219 |
| 8,002,446 | B1 | 8/2011 | Plunk et al. | |
| 8,313,212 | B1 * | 11/2012 | Mayer et al. | F21S 2/005 362/217.13 |
| 2011/0285314 | A1 * | 11/2011 | Carney et al. | 315/294 |

OTHER PUBLICATIONS

U.S. Appl. No. 13/285,564, filed Oct. 31, 2011, 29 pages.

Philips, *Virage*™. Tupelo, Mississippi: Philips Day-Brite, 2010. Print.

* cited by examiner

*Primary Examiner* — Sean Gramling

(74) *Attorney, Agent, or Firm* — Kilpatrick Townsend & Stockton, LLP

(57) ABSTRACT

Embodiments of the invention include a luminaire with an elongated luminaire body and at least one longitudinal luminaire flange each of which extend longitudinally from one end of the luminaire body. The luminaire body being shorter than the luminaire length measured from the ends of both longitudinal luminaire flanges. The luminaire body can include a channel with a plurality of light sources, optical elements, power lines, and/or control lines. A connector is also disclosed according to some embodiments of the invention that can be used to physically and/or electrically couple two luminaires together. The connector can couple the luminaires at a T-bar.

13 Claims, 11 Drawing Sheets

CEILING-RECESSED LUMINAIRE

FIELD

Embodiments of the invention are directed toward indoor lighting luminaires.

BACKGROUND

A common ceiling interface in commercial construction is the suspended T-grid ceiling with acoustic tiles. Lighting equipment design is often tailored for installation in grid ceilings through numerous different methods ranging from the use of independent support clips for suspended fixtures, hanger bars for down lights, and tie-offs for lay in troffers. Continuous linear applications are most common with the use of suspended lighting products since the luminaire is on an offset parallel plane to the ceiling. This can simplify the lighting design and installation as the rows of suspended luminaires do not interfere with the ceiling grid construction. This also makes it ideal for retrofit applications.

BRIEF SUMMARY

Embodiments of the invention include a luminaire with an elongated luminaire body for housing luminaire components, such as light sources, optical elements, power lines, and/or control lines. At least one longitudinal luminaire flange which extends longitudinally from one each end of the luminaire body. The luminaire body is designed to be inserted between and retained by T-bars, leaving the flanges exposed underneath the T-bars. being shorter than the luminaire length measured from the ends of both longitudinal luminaire flanges. The luminaire body can include a channel with a plurality of light sources, optical elements, power lines, and/or control lines. In use, positioning adjacent luminaires on T-bars in this way creates the appearance of a single, linear luminaire extending along the ceiling. A connector is also disclosed according to some embodiments that can be used to physically and/or electrically couple two adjacent luminaires together. The connector can couple the luminaires at a T-bar.

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

BRIEF DESCRIPTION OF THE DRAWINGS

Illustrative embodiments of the present invention are described in detail below with reference to the following drawing figures.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments of the invention include a ceiling recessed luminaire configured to couple with one or more T-bars within a ceiling T-grid application. The luminaire can include a plurality of LEDs and/or optics that are configured to direct light downwardly from within the luminaire body.

Figure 1:
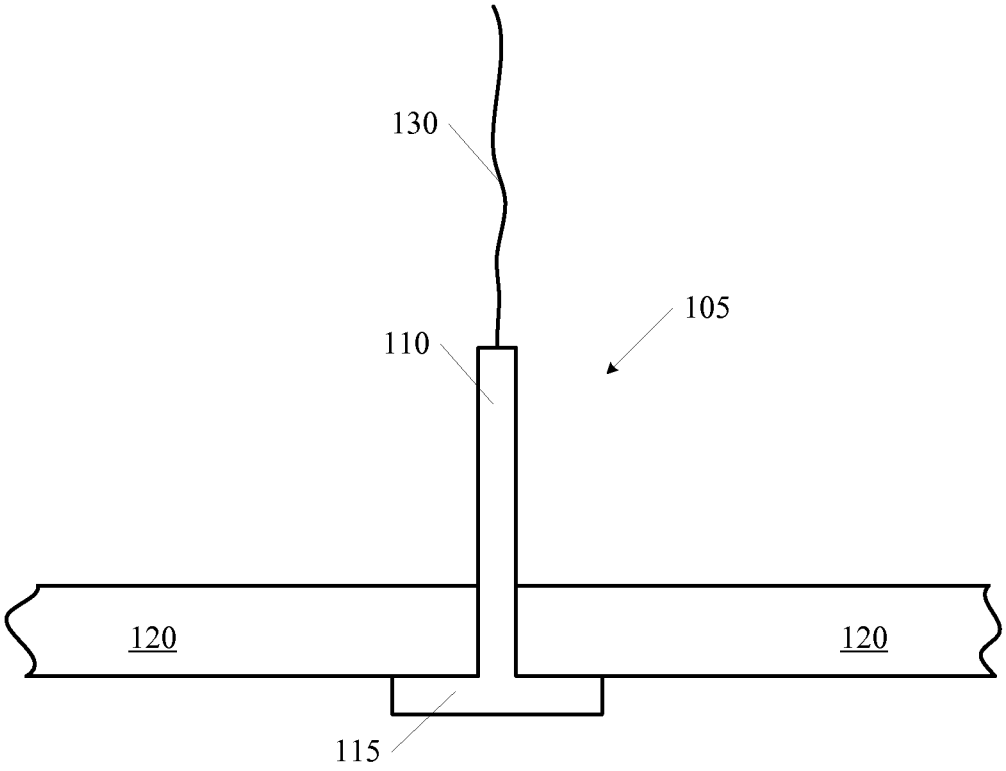
FIG. 1 shows a cross-section of a portion of a dropped ceiling with a T-bar and ceiling panels.

A typical drop ceiling is formed by a plurality of T-bars (such as T-bar 105 shown in FIG. 1) that are oriented in a grid-like pattern so that openings are formed between adjacent T-bars. In the U.S., the T-bars 105 are often arranged in a 2×2 foot or 4×2 foot grid but any other grid patterns or dimensions can be used.

Each T-bar 105 typically includes a horizontal portion 115 and a vertical portion 110. Ceiling panels 120 rest on horizontal portions 115 of adjacent T-bars 105 so as to cover the openings formed by the T-bars 105 and thereby form a dropped ceiling. The area above the dropped ceiling is called the plenum. T-bars 105 can be suspended from the ceiling or another structure using wire 130.

While a T-bar grid is described herein, embodiments of the invention can be implemented or modified to work with other types of dropped grid ceiling configurations.

Figure 2A:
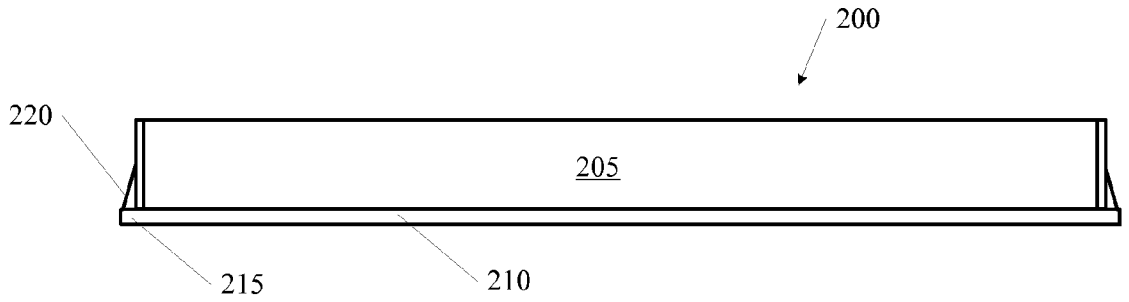
FIG. 2A shows an elevation view and FIG. 2B shows a bottom view of a luminaire with an elongated luminaire body and a longitudinal luminaire flange and retractable clips according to some embodiments of the invention.
Figure 2B:
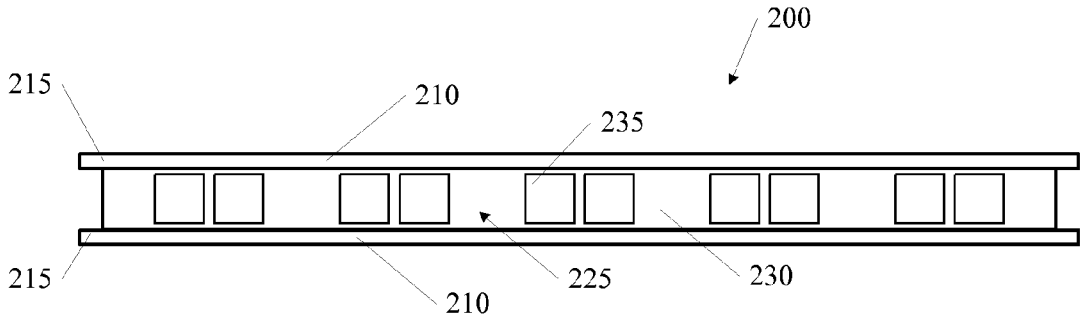

FIG. 2A shows a side view and FIG. 2B shows a bottom view of an embodiment of a luminaire 200 with elongated luminaire body 205 that defines a channel 225. Channel 225 that can house a variety of components, including, but not limited to, light sources (such as, but not limited to, LEDs), optics, electrical power, electrical control circuitry, through wires, heat sinks, drivers, etc.

Figure 9A:
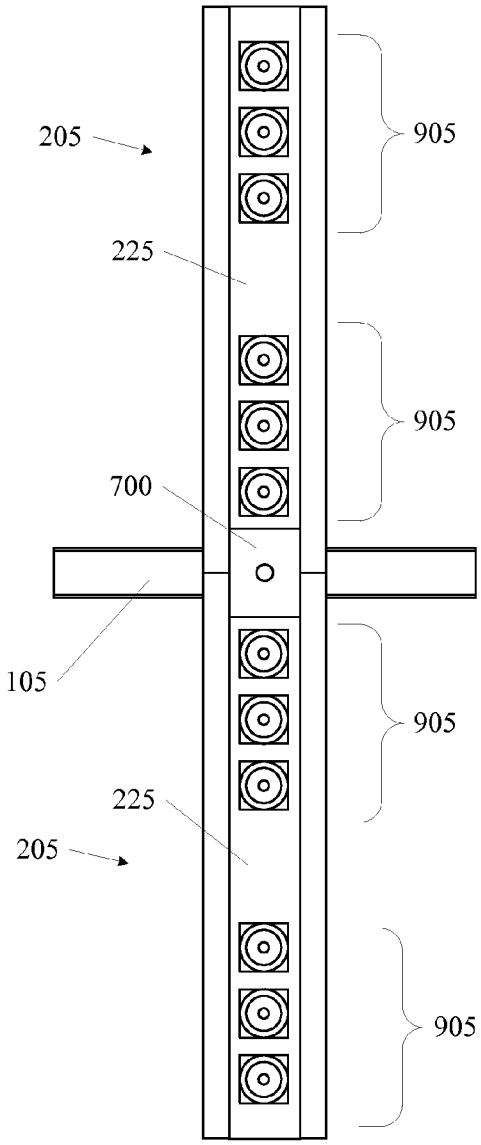
FIGS. 9A and 9B are bottom plan views of different embodiments of luminaires installed on a T-bar and illustrate LEDs and/or primary focusing optics grouped in various patterns according to some embodiments of the invention.
Figure 9B:
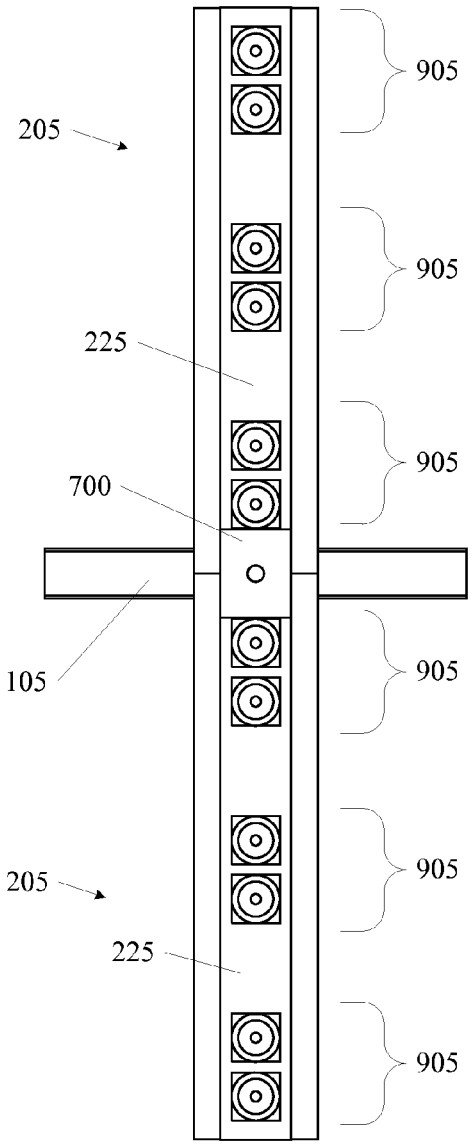

In some embodiments, luminaire body 205 can include a bottom cover 230 may that can be used to cover enclose the various components housed within luminaire body 205. Bottom cover 230 can be disposed flush with the bottom of side flanges 210, flush with the top of side flanges 210, or disposed at any other portion of the luminaire near or location relative to channel 225 so as to at least partially enclose the channel 225. A plurality of apertures 235 can be cut provided within bottom cover 230 so as to allow light from light sources to exit luminaire body 205. Any number, type, shape, or configuration of apertures 235 can be used. Light sources disposed within luminaire body 205 can direct light downwardly from within the luminaire body 205 through apertures 235. In some embodiments, a number of light sources can be distributed along the longitudinal length of the luminaire body in a single or double line of light sources (e.g., as shown in FIGS. 9A and 9B). Any number of light sources can be retained or oriented and retained in any way within channel 225 of luminaire body 205.

In some embodiments, LEDs and optics can focus light from within luminaire body downwardly onto a suspended optical and/or aesthetic component that redistributes light into the space as described in U.S. patent application Ser. No. 13/285,564, titled Two Component Direct-Indirect lighting System, filed Oct. 31, 2010, which is incorporated herein by reference in its entirety.

Flanges may extend outwardly from the luminaire body 205, such as, but not limited to, the bottom of the luminaire body 205. In some embodiments, end flanges 215 extend beyond the ends of the luminaire body 205. In some embodiments, side flanges 210 extend outwardly from the sides of the luminaire body 205. Some embodiments of the luminaire 200 include both side and end flanges 210, 215. In some embodiments, the flanges 210, 215 are integrally-formed with the luminaire body 205. For example, luminaire body 205 and the flanges 210, 215 can be molded from a polymeric material or formed from a single piece of sheet metal. However, these parts could also easily be formed separately and attached using known mechanical and/or chemical retention methods.

Side flanges 210 (if provided) may extend (1) along the entire length of the luminaire body 205, (2) less than the entire length of the luminaire body 205, or (3) beyond the length of the luminaire body, in which case the side flanges 210 essentially become end flanges 215, as described below. In some embodiments, side flanges 210 extend beyond the have a width that is greater than the width of luminaire body 205 to allow ceiling panels to rest on the top surface of side flanges 210.

End flanges 215 projects beyond the ends of the luminaire body 205 when viewed from the side (see, e.g., FIG. 2A). End flanges 215 may project across the entire width of the luminaire body 205 but need not. By way only of example, in some embodiments (see, e.g., FIG. 6) the side flanges 210 extend along the sides of the luminaire body 205 beyond the ends of the luminaire body 205 so as to form the end flanges 215. In this way, the end flanges 215 are an extension of the side flanges 210.

In some embodiments, luminaire body 205 is shorter in length than the distance between the distal ends of end flanges 215 so that the luminaire body 205 can fit between adjacent T-bars 105 of a grid opening and be recessed within the plenum, while the end flanges 215 abut the bottom of the T-bars 105, as will be shown and discussed in more detail below. In some embodiments, the distance between the distal ends of the end flanges approximates the distance between the center points of adjacent T-bars 105. In this way, the end flanges 215 of adjacent luminaires 200 terminate at the same relative location on the T-bars 105.

In some embodiments, luminaire body 205 has a length of approximately 23" or 47". In other embodiments, luminaire body 205 has a length of 0.5 meters, 1 meter, 1.5 meters, or 2 meters give or take one to two centimeters. Luminaire body 205 can have a width of about 0.5", 1.0", 1.5", 2", 2.5", 3", 3.5", 4", 4.5", 5", 5.5" or, 6"; for example, luminaire body can have a width of less than or equal to 1", 9/16" or 15/16". In some embodiments, end flange 215 can extend less than or equal to 1/4", 1/2", 9/32" or 15/32" from the ends of the luminaire body 205, and/or side flanges 210 can project laterally 1/4", 1/2", 9/32" or 15/32" from the sides of the luminaire body 205.

Figure 3:
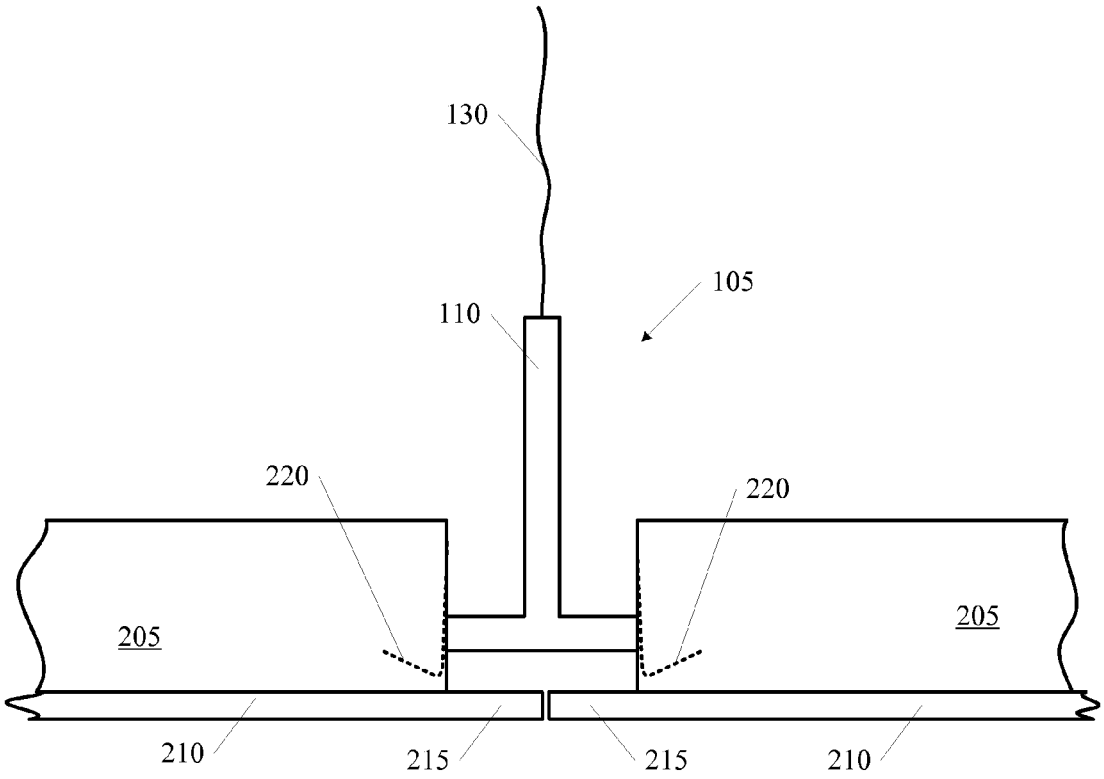
FIG. 3 is a side elevation view of two luminaires being inserted into a ceiling opening with retention clips in a retracted position according to some embodiments of the invention.
Figure 4:
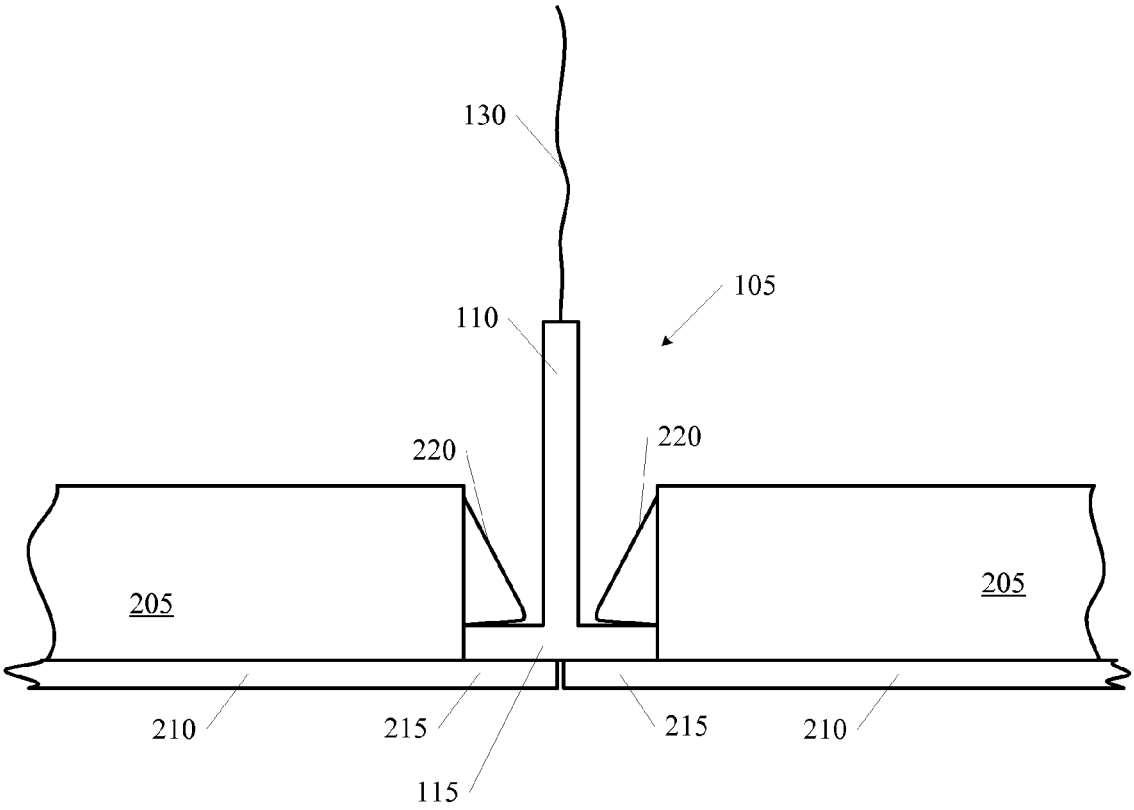
FIG. 4 is a side elevation view of the two luminaires of FIG. 3 retained on a T-bar with the clips in an extended position according to some embodiments of the invention.

Luminaire 200 can be retained within the ceiling by coupling with T-bars 105. In some embodiments (see FIGS. 2, 3 and 4), retractable clips 220 are coupled to the ends of the luminaire body 205 and are designed to assume a retracted position when the luminaire 200 is inserted into the ceiling from below and an extended position to retain the luminaire 200 within the ceiling after insertion. By way only of example, retractable clips 220 can include springs coupled with both ends of a luminaire body 205 that allow retractable clips 220 to deflect inwardly when luminaire body 205 is raised through a grid opening (FIG. 3). Once the luminaire body 205 clears the T-bar 105, the retractable clips 220 are able to return to their equilibrium state and rest upon the horizontal portion 115 of T-bar 105 (FIG. 4). In this way, the weight of the luminaire is transferred to the T-bar 105 with via the retractable clips 220 in the non-retracted position. Moreover, as shown in FIG. 4, when so positioned the luminaire body 205 is recessed within the plenum, but the end flanges 215 are prevented by the T-bar 105 from extending upwardly into the plenum. Rather, the end flanges 215 abut or are located proximate the bottom of horizontal portion 115 of T-bar 105 so that the end flanges 215 (and side flanges 210 if provided) are visible from below.

Figure 5:
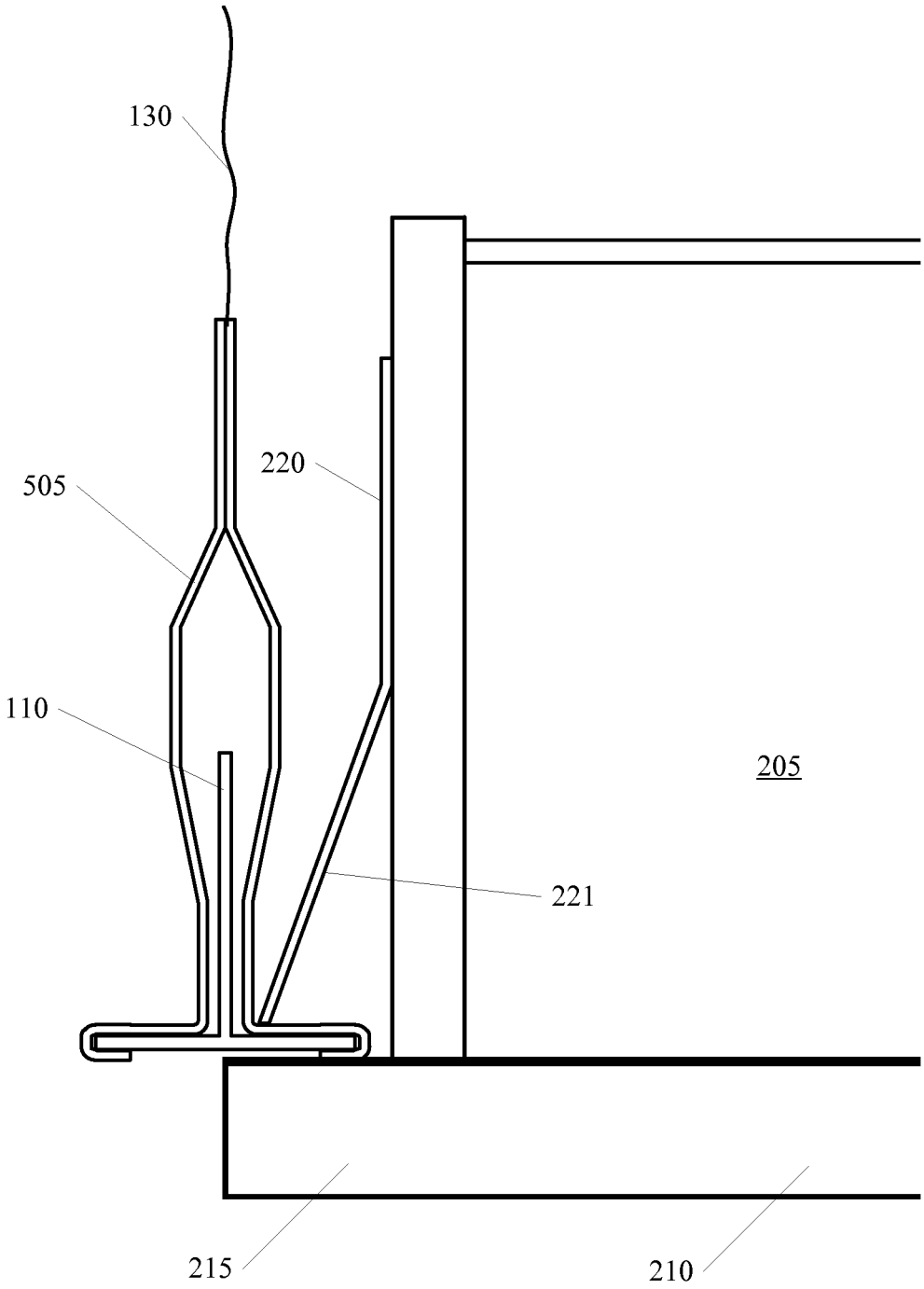
FIG. 5 shows an independent support clip coupled with the T-bar and the luminaire according to some embodiments of the invention.

Retractable clips 220, for example, can be fabricated from spring metal in a curved or crooked shape so that engagement portion 221 extends away from luminaire body as shown in FIG. 5. During installation, engagement portion can be compressed toward luminaire body when luminaire body 205 is raised through a grid opening. Once the luminaire body 205 clears the T-bar 105, retractable clips 220 are able to return to their equilibrium state as shown in the figure and rest upon the horizontal portion 115 of T-bar 105. Various other configurations of retractable clips 220 can be used.

In some embodiments, an end cap 750 is mounted on one or both ends of the luminaire body 205. End cap 750 can include tab socket 755 and electrical sockets 760, the utility of which are described in more detail below. While six electrical sockets 760 are shown, any number can be used. Electrical sockets 760 can be electrically coupled with through wiring within luminaire body 205 that can include power, communication, and/or control lines. In some embodiments, retractable clips 220 can be coupled to end cap 750.

In some configurations T-bar 105 can be supported from above by wire 130 coupled with a traditional or custom independent support (IDS) clip 505 as shown in FIG. 5. IDS clips are well known in the art. IDS clip 505 can couple with horizontal portion 115 of T-bar 105. IDS clip 505 can support the weight of a number of T-bars 105 and other ceiling structures. In some embodiments, luminaire body 205 can couple with T-bar 105 at or near IDS clip 505 to support the additional weight of luminaire body 205.

In some embodiments, other components of a lighting system can be coupled at or near IDS clip 505. For example, suspended optics can also couple with IDS clip 505 as described, in U.S. patent application Ser. No. 13/285,564, titled Two Component Direct-Indirect lighting System, filed Oct. 31, 2010, which is incorporated herein by reference in its entirety.

Figure 6:
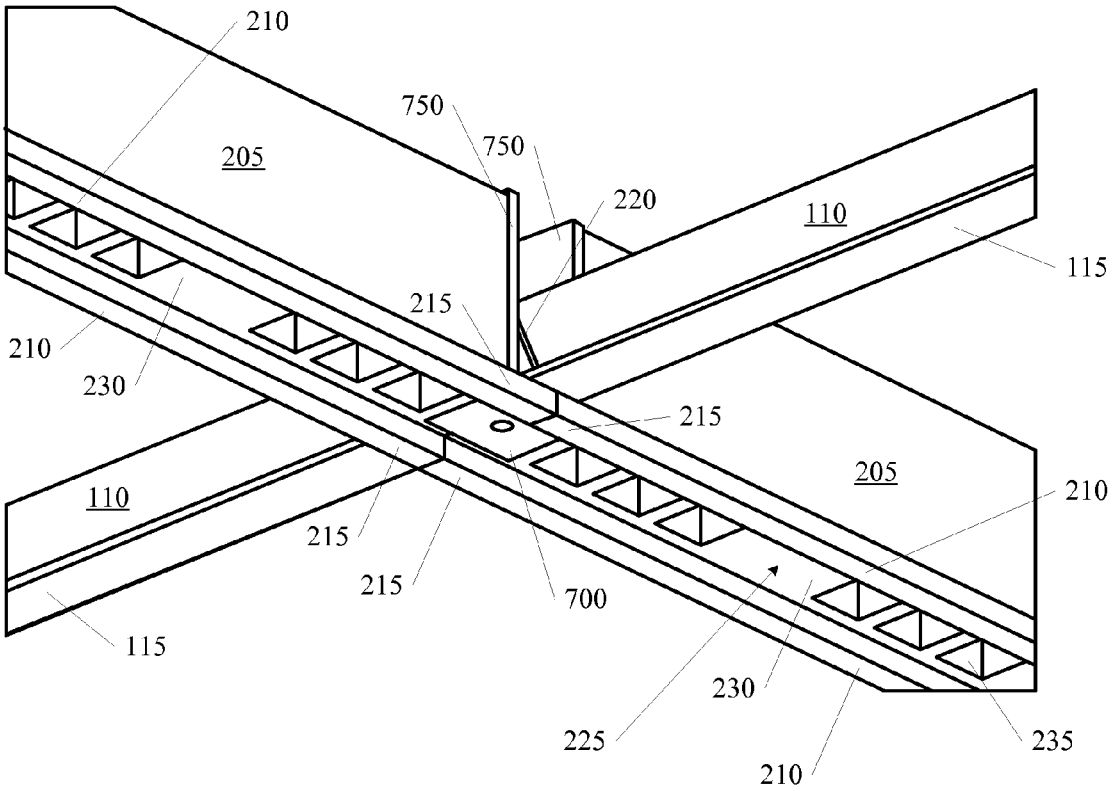
FIG. 6 is a bottom perspective view of two luminaires retained on a T-bar according to some embodiments of the invention.

FIG. 6 shows two luminaire bodies 205 retained on T-bar 105 according to some embodiments of the invention. Retractable clips 220 rest on the upper surface of horizontal portion 115 of T-bar 105, thereby supporting the luminaire bodies 205 within the plenum 200. The end flanges 215 extend and are visible below the bottom of horizontal portion 115 of T-bar 105 and the side flanges 210 are available to support ceiling panels if desired.

Each luminaire body 205 can include channel 225 that extends along the longitudinal length of each luminaire body 205. Channel 225 can be defined by two bottom portions 610 that extend along the longitudinal length of each luminaire body side flange 210 and/or end flange 215 can be formed by or within the two bottom portions 610.

Some embodiments of the invention include a connector that can join and/or align adjacent luminaires to one another, to a T-bar, and/or to an IDS clip.

Figure 7A:
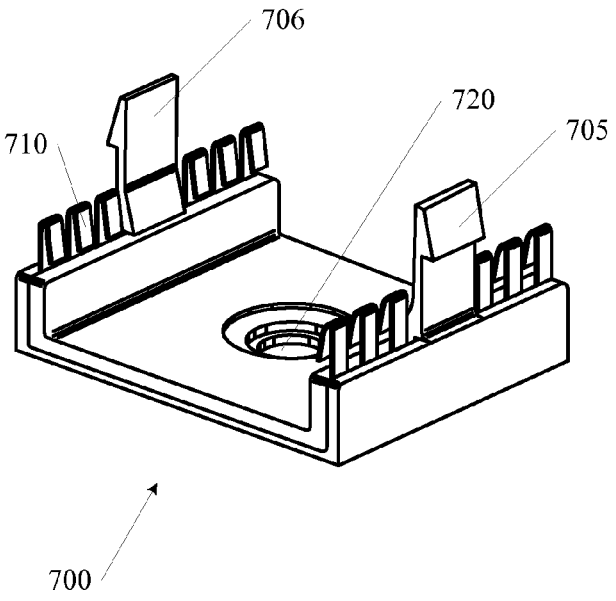
FIG. 7A is a top perspective view of an embodiment of a connector according to some embodiments of the invention.
Figure 7B:
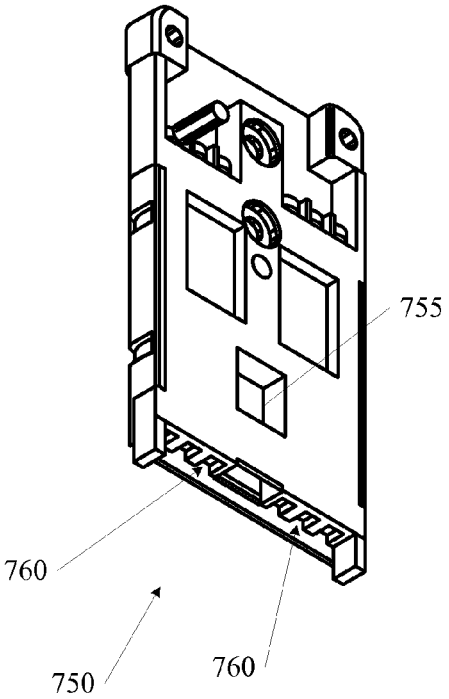
FIG. 7B is a bottom perspective view of an embodiment of a luminaire end cap according to some embodiments of the invention.

FIG. 7A illustrates an embodiment of connector 700. Connector 700 includes tabs 705 and 706 and electrical terminals 710. While six electrical terminals 710 are shown, any number can be used. Connector 700 can include a plurality of electrical terminals 710 that can be used to electrically couple two luminaires. Electrical terminals 710 can include through wiring that couples electrical terminals on one side of connector 700 to electrical terminals on the other side of connector 700. Connector 700 can also include alignment hole 720 that can be used in conjunction with an alignment pin to ensure proper positioning of connector 700, but such a feature is entirely optional. Tabs 705 and 706 of connector 700 can engage with tab socket 755 to physically couple connector 700 with end cap 750 on a luminaire body 205. Electrical terminals 710 of connector 700 can plug into electrical sockets 760 in end cap 750. Moreover, connector 700 can electrically connect through-wiring inside of two luminaires thereby forming a continuous electrical bus.

Connector 700 can be installed at the junction of two luminaires underneath T-bar 105 so as to align the two adjacent luminaires 200 and/or cover the portion of T-bar 105 between the end flanges 215 of adjacent luminaires 200.

Figure 8A:
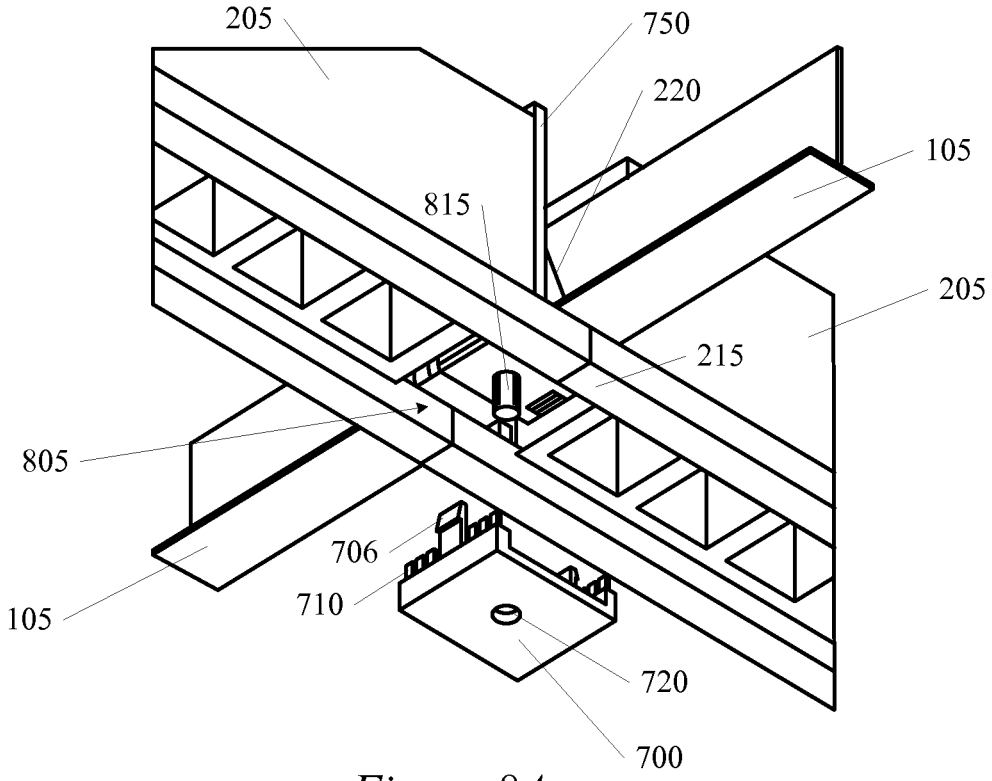
FIG. 8A is a partially exploded view illustrating a connector being coupled with two luminaires and a T-bar according to some embodiments of the invention.
Figure 8B:
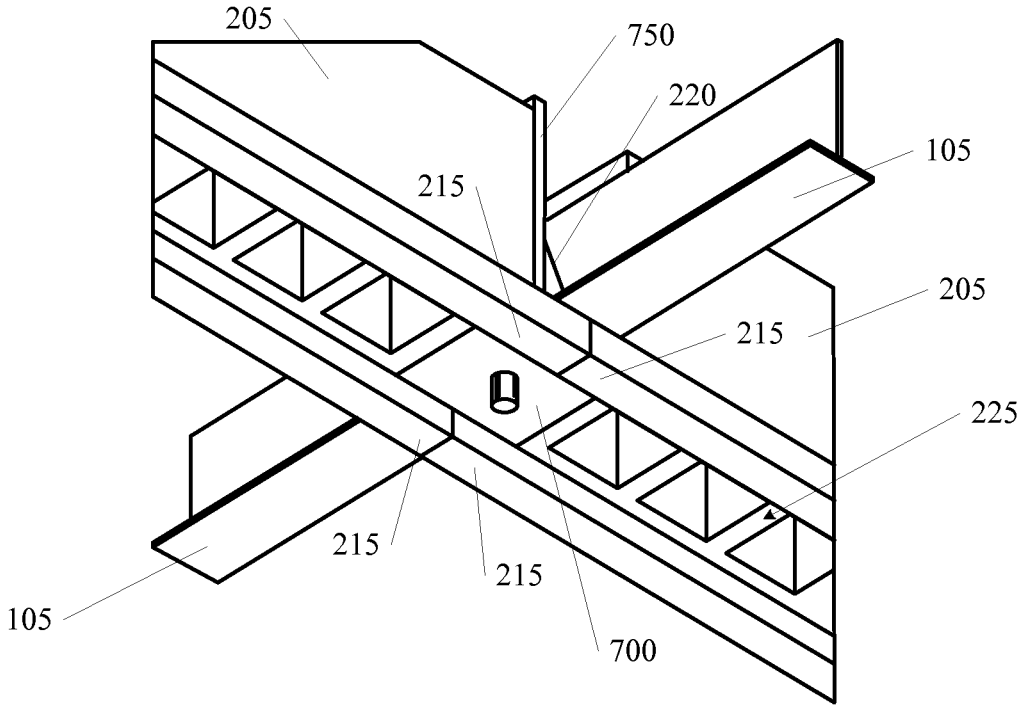
FIG. 8B is a bottom perspective view illustrating the connector of FIG. 8A installed with the two luminaries and the T-bar.

FIG. 8A shows connector 700 in position to be coupled with two luminaires 200 and T-bar 105 according to some embodiments of the invention. To couple connector 700 into place, connector 700 is positioned within gap 805 defined by the end flanges 215 extending from the adjacent luminaire bodies 205. Alignment pin 815 (if provided) can be coupled with T-bar 105, for example, by being snap fit onto T-bar 105. Connector 700 can be positioned into channel gap 805 by aligning alignment hole 720 with alignment pin 815 as shown in FIG. 8B. As the connector 700 is inserted, tabs 705 and 706 of connector 700 engage with tab socket 755 in end caps 750 to physically couple connector 700 with end caps 750 of the luminaires 200. Electrical terminals 710 of connector 700 plug into electrical sockets 760 in end caps 750, thereby electrically connecting through-wiring inside of the two luminaires to form a continuous electrical bus. Connector 700 thereby sits within the channel.

In this way, connector 700 aligns and couples the two luminaire bodies 205 so that little to no gap appears between the adjacent luminaires 200. In this way, when installed, the two luminaires 200 have the appearance of a single linear luminaire. This appearance can be enhanced by manufacturing the connector 700 to have a color, texture, and/or appearance that matches the undersides of the end flanges 215, side flanges 210 and/or bottom cover 230 as well as the interior of the luminaire to create a continuous-look to a linear run of installed sections. Moreover, in some embodiments, a continuous appearance is further augmented by the fact that channel 225 is deep enough such that the connector is recessed relative to the bottom of channel 225 once it is fully inserted.

FIGS. 9A and 9B show LEDs and/or primary focusing optics grouped in various patterns according to some embodiments of the invention. FIG. 9A shows LEDs and/or primary focusing optics clustered in groups of three LEDs 905 disposed within channel 225. FIG. 9B shows LEDs and/or primary focusing optics clustered in groups of two LEDs 905 disposed within channel 225. Various other groupings of one or more LEDs can be used in other embodiments. In some embodiments, the spacing between groups can match the gap across the T-grid occupied by the connector 700 to further disguise the existence of the connector 700 and enhance the overall continuous appearance of the luminaires 200.

In some embodiments, LEDs and/or optics can be positioned in various arrangements along the longitudinal length of multiple luminaires coupled together and provide a continuous illumination pattern. In some embodiments, this can include directing light into the area on or below end flanges 215 and/or T-bars 105 to compensate for not having light sources in this area. In some embodiments, one or more LEDs and/or optics can be disposed within end flanges 215. These light sources may be different from or the same as other light sources used within the luminaires 200. In other embodiments, one or more LEDs and/or optics can be disposed within connector 700.

A cover lens, which may or may not be part of bottom cover 230, can be placed at the bottom of the channel that extends the longitudinal length of the channel to provide a linear lighting effect. The cover lens can be placed flush with the bottom surfaces of side flanges 210 and/or end flanges 215. The various light fixture configurations disclosed herein and/or any others can direct light through the lens and into an architectural space.

Figure 10A:
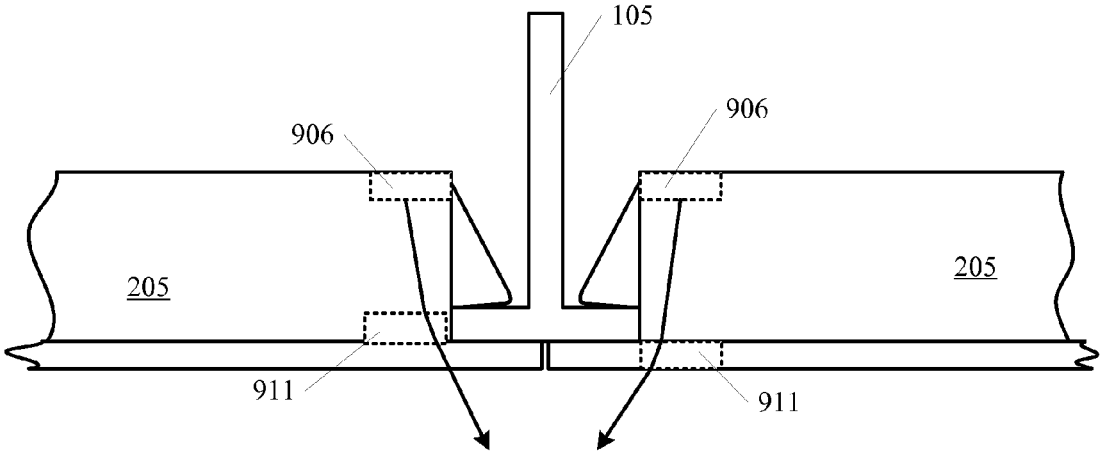
FIGS. 10A, 10B and 10C show cross-sectional views of different embodiments of luminaires installed on a T-bar and having one or more LEDs and/or optics to direct light beneath the T-bar.

In some embodiments, one or more LEDs 906 and/or optics 911 can be positioned in either position shown in FIG. 10A to direct light into the area below T-bar 105. Optics 911 can be placed either within luminaire body 205 and/or within channel 225. Light from LEDs 906 can be directed through optics 911, which bend the light downwardly beneath T-bar 105 as shown in the figure. Optics 911 may optionally be placed within channel 225 and/or the cover lens that is flush with the bottom of side flanges at least partially covers the opening of the channel 225.

Figure 10B:
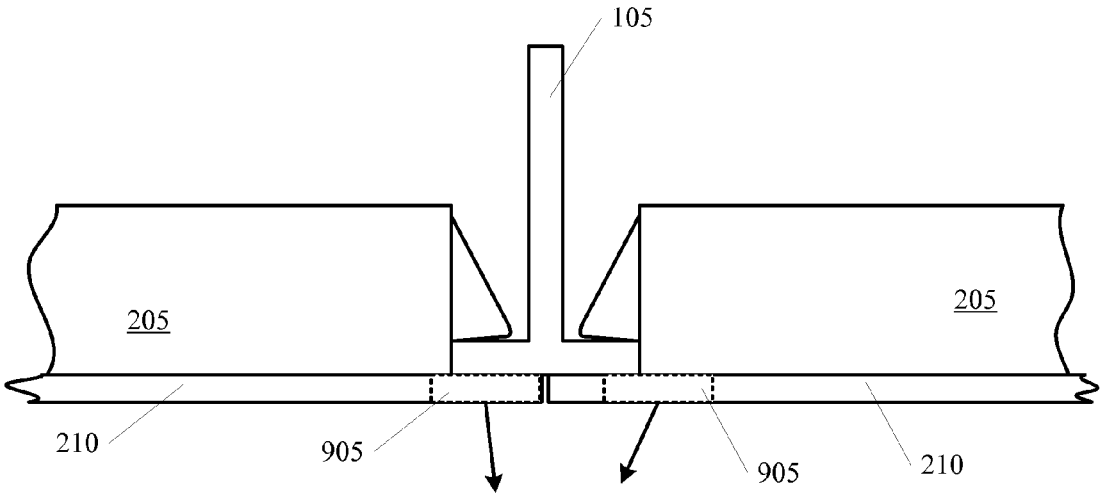

In other embodiments, one or more LEDs 905 and/or optics can be positioned within channel (such as between side or end flanges 210, 215) as shown in FIG. 10B to direct light into the area beneath T-bar 105. Apertures may be cut within bottom cover 230 to allow light to pass through the bottom surface if used. As shown, LEDs 905 can be placed in different portions of the channel. Light from LEDs 905 can be directed downward beneath T-bar 105 as shown in the figure.

Figure 10C:
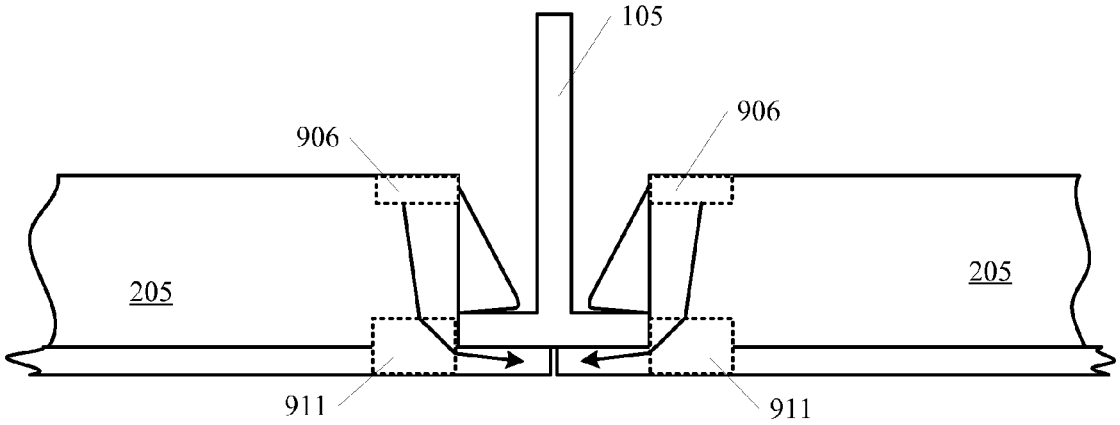

In yet other embodiments, optics 911 can extend into both the housing and the channel as shown in FIG. 10C. The optics can direct light from LEDs 906 into the channel underneath T-bar 105. A clear translucent, refractive and/or diffusing bottom cover lens 230 (not shown) can extend along all or portions of the length of luminaire 200. The light being directed into the channel beneath T-bar can illuminate the architectural space through the bottom surface. In this way, a continuous light presentation can be provided that extends along the length of the luminaire. Moreover, when two or more luminaires are coupled together a continuous light presentation can be provided that extends along the length of all luminaires. Connector 700, which can couple the luminaires together, can include a clear translucent, refractive, and/or diffusing cover lens and/or LEDs to ensure continuity of light across the luminaires.

In still other embodiments, organic light-emitting diodes (OLEDs) or other element that can produce light form a substantially planar surface, can be placed along the bottom of channel 225 or as part of bottom cover 230 to illuminate the architectural space. These OLEDs can also be positioned in the channel between side and/or end flanges 210, 215 beneath T-bar 105. These OLEDs can provide a continuous light presentation. Such OLEDs can be used in conjunction with LEDs or alone. In some embodiments, OLEDs can be placed on connector 700 to provide light beneath T-bar 105.

The invention has been described in respect to a number of embodiments of the invention. Other embodiments of the invention can extend to continuous linear recessed luminaires that may be easily configurable and/or installable with modular components. For example, a lighting system may include a recessed track channel for positionable accent lighting heads. As another example, a lighting system could emit light from within the channel and/or from a lens near or at the aperture of the channel without the use of a secondary suspended optical component. As yet another example, lighting systems may apply to horizontally-oriented wall-recessed luminaires where a continuous look across wall studs can be achieved in a simple to install and configure modular system that does not require custom framing and can be readily used in retrofit applications. In fact, any embodiment of the invention can be used in new construction, standard framing, custom framing, or retrofit applications.

Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

What is claimed is:

1. A lighting system for a grid ceiling system, comprising:

a first luminaire comprising a first luminaire body, a first light source and a first plurality of electrical contacts, wherein at least one of the first plurality of electrical contacts is electrically coupled with the first light source;

a second luminaire comprising a second luminaire body, a second light source and a second plurality of electrical contacts, wherein at least one of the second plurality of electrical contacts is electrically coupled with the second light source; and a connector comprising:

a rectangular body that defines opposing upwardly and downwardly facing sides, opposing first and second ends that define a connector length, and opposing lateral sides that define a connector width, a first plurality of electrical terminals extending upwardly from the upwardly facing side at the first end, and configured to couple with the first plurality of electrical contacts, and a second plurality of electrical terminals extending upwardly from the upwardly facing side at the second end, and configured to couple with the second plurality of electrical contacts, wherein the connector defines an aperture that extends from the upwardly facing side through the downwardly facing side, the aperture being equidistant from the lateral sides, such that an alignment pin protruding downwardly from a T-bar of a grid ceiling system passes through the aperture when the first plurality of electrical terminals couples with the first plurality of electrical contacts and the second plurality of electrical terminals couples with the second plurality of electrical contacts.

2. The lighting system according to claim 1, wherein:

the first plurality of electrical contacts comprises at least two downwardly facing sockets arranged in a first straight line perpendicular to a length of the first luminaire, the second plurality of electrical contacts comprises at least two downwardly facing sockets arranged in a second straight line perpendicular to a length of the second luminaire, the first plurality of electrical terminals comprises at least two electrical terminals, arranged in a third straight line along the first end of the connector and extending upwardly from the upwardly facing side of the connector, the second plurality of electrical terminals comprises at least two electrical terminals, arranged in a fourth straight line along the second end of the connector and extending upwardly from the upwardly facing side of the connector, such that the first and second pluralities of electrical terminals can couple with the first luminaire and the second luminaire only when the first luminaire body and the second luminaire body are arranged in a relatively straight line.

3. The lighting system according to claim 1, wherein the first luminaire and the second luminaire are configured to provide a single or double line of the light sources across the luminaires when coupled together with the connector.

4. The lighting system according to claim 1, wherein:

the first luminaire body comprises first and second flanges extending longitudinally from an end of the first luminaire body, the first and second flanges defining a first channel characterized by a channel width;

the second luminaire body comprises third and fourth flanges extending longitudinally from an end of the second luminaire body, the third and fourth flanges defining a second channel characterized by the channel width; and the connector width is less than the channel width, such that the connector fits within the first and second channels when coupled with the first and second luminaires.

5. The lighting system according to claim 4, wherein the first flange and the second flange are configured to extend beneath a support feature of the grid ceiling system.

6. The lighting system according to claim 5, wherein the connector covers a portion of the support feature between the first flange and the second flange.

7. The lighting system according to claim 1, wherein the first luminaire has a width of less than or equal to four inches and the second luminaire has a width of less than or equal to four inches.

8. The lighting system according to claim 1, wherein:

the first and second pluralities of electrical terminals and the first and second pluralities of electrical contacts are equal in number;

each of the first plurality of electrical terminals couples with a corresponding one of the second plurality of electrical terminals within the connector; and each of the first plurality of electrical contacts couples with a corresponding one of the second plurality of electrical contacts through the first and second pluralities of electrical terminals in the connector.

9. The lighting system according to claim 1, further comprising a cover lens disposed beneath at least one of the first and second light sources such that light emitted from the at least one of the first and second light sources passes through the cover lens.

10. The lighting system according to claim 1, wherein at least one of the first and second luminaires comprises a retractable clip that engages a support feature of the grid ceiling system.

11. The lighting system according to claim 10, wherein the retractable clip is spring loaded such that when the at least one of the first and second luminaires is raised with respect to the support feature, the retractable clip deflects inwardly, and when the at least one of the first and second luminaires clears the support feature, the clip extends outwardly and rests upon the support feature.

12. A lighting system for a grid ceiling system, comprising:

a first luminaire comprising a first luminaire body, a first light source and a first plurality of electrical contacts, wherein:

at least one of the first plurality of electrical contacts is electrically coupled with the first light source, the first plurality of electrical contacts comprises at least two downwardly facing sockets arranged in a first straight line perpendicular to a length of the first luminaire, and the first luminaire defines a first tab socket disposed along the first straight line;

a second luminaire comprising a second luminaire body, a second light source and a second plurality of electrical contacts, wherein:

at least one of the second plurality of electrical contacts is electrically coupled with the second light source;

the second plurality of electrical contacts comprises at least two downwardly facing sockets arranged in a second straight line perpendicular to a length of the second luminaire, and the second luminaire defines a second tab socket disposed along the second straight line; and a connector comprising:

a rectangular body that defines opposing upwardly and downwardly facing sides, opposing first and second ends that define a connector length, and opposing lateral sides that define a connector width, a first plurality of electrical terminals extending upwardly from the upwardly facing side at the first end, and configured to couple with the first plurality of electrical contacts, the first plurality of electrical terminals comprising at least two electrical terminals, arranged in a third straight line along the first end of the connector and extending upwardly from the upwardly facing side of the connector, and a second plurality of electrical terminals extending upwardly from the upwardly facing side at the second end, and configured to couple with the second plurality of electrical contacts, the second plurality of electrical terminals comprising at least two electrical terminals, arranged in a fourth straight line along the second end of the connector and extending upwardly from the upwardly facing side of the connector, such that the first and second pluralities of electrical terminals can couple with the first luminaire and the second luminaire only when the first luminaire body and the second luminaire body are arranged in a relatively straight line, and wherein the connector comprises a first tab, extending upwardly from the first end and disposed along the third straight line, and a second tab, extending upwardly from the second end and disposed along the fourth straight line;

such that the first and second tabs are configured to engage with the first and second tab sockets respectively.

13. A lighting system for a grid ceiling system, comprising:

a first luminaire comprising:

a first luminaire body, a first light source, a first plurality of electrical contacts, wherein at least one of the first plurality of electrical contacts is electrically coupled with the first light source, and first and second flanges extending longitudinally from an end of the first luminaire body, the first and second flanges defining a first channel characterized by a channel width, wherein the first flange and the second flange are configured to extend beneath a support feature of the grid ceiling system;

a second luminaire comprising:

a second luminaire body, a second light source, a second plurality of electrical contacts, wherein at least one of the second plurality of electrical contacts is electrically coupled with the second light source, and third and fourth flanges extending longitudinally from an end of the second luminaire body, the third and fourth flanges defining a second channel characterized by the channel width; and a connector comprising:

a rectangular body that defines opposing upwardly and downwardly facing sides, opposing first and second ends that define a connector length, and opposing lateral sides that define a connector width, wherein the connector width is less than the channel width, such that the connector fits within the first and second channels when coupled with the first and second luminaires, a first plurality of electrical terminals extending upwardly from the upwardly facing side at the first end, and configured to couple with the first plurality of electrical contacts, and a second plurality of electrical terminals extending upwardly from the upwardly facing side at the second end, and configured to couple with the second plurality of electrical contacts;

wherein:

the support feature of the grid ceiling system is characterized by a support feature width;

the connector length is greater than the support feature width;

when installed, the first luminaire body and the second luminaire body are disposed perpendicular to, and on opposite sides of, the support element;

the connector separates the first luminaire body and the second luminaire body by at least the support feature width when the connector couples the first and second luminaires;

the first and second flanges are configured to extend beyond the first luminaire body by about half of the support feature width;

the third and fourth flanges are configured to extend beyond the second luminaire body by about half of the support feature width; and the first and second flanges substantially abut the third and fourth flanges beneath the support feature when the first and second pluralities of electrical terminals couple with the respective first and second pluralities of electrical contacts.

* * * * *